US008485564B2

(12) United States Patent
Chen

(10) Patent No.: US 8,485,564 B2
(45) Date of Patent: Jul. 16, 2013

(54) THREAD STRUCTURE OF AERATOR OF FAUCET WATER OUTLET

(75) Inventor: Chi-Chuan Chen, Lu Kang Township, Changhua County (TW)

(73) Assignee: Chuan Wei Metal Co., Ltd., Changhua County (TW)

( * ) Notice: Subject to any disclaimer, the term of this patent is extended or adjusted under 35 U.S.C. 154(b) by 86 days.

(21) Appl. No.: 13/286,602

(22) Filed: Nov. 1, 2011

(65) Prior Publication Data

US 2013/0105022 A1 May 2, 2013

(51) Int. Cl.
*F16L 15/00* (2006.01)

(52) U.S. Cl.
USPC ..... 285/390; 285/12; 239/428.5

(58) Field of Classification Search
USPC ..... 285/390, 12, 333, 355; 239/428.5
See application file for complete search history.

(56) References Cited

U.S. PATENT DOCUMENTS

| | | | | |
|---|---|---|---|---|
| 2,971,701 | A * | 2/1961 | Shames et al. | 239/428.5 |
| 3,450,350 | A * | 6/1969 | Gullaksen | 239/428.5 |
| 4,822,076 | A * | 4/1989 | Padilla | 285/8 |
| 7,252,248 | B2 * | 8/2007 | Cutler | 239/428.5 |
| 2003/0042337 | A1 * | 3/2003 | Liang et al. | 239/428.5 |
| 2003/0197072 | A1 * | 10/2003 | Flieger | 239/428.5 |
| 2005/0087717 | A1 * | 4/2005 | Burke | 251/263 |
| 2007/0108314 | A1 * | 5/2007 | Cutler | 239/428.5 |
| 2007/0194154 | A1 * | 8/2007 | Katzer | 239/428.5 |

* cited by examiner

*Primary Examiner* — David E Bochna

(57) ABSTRACT

A thread structure for an aerator of a water faucet outlet, wherein an internal and/or external thread structure of the aerator enables the aerator to be engaged with both metric and imperial internal threads on the water faucet outlet, wherein the dimensions of the structure is based on the pitch, the major diameter and the pitch diameter of the metric and imperial thread of the water faucet outlet and the variation tolerance, and wherein calculations are made based on the universal measurement of corresponding pitch, major diameter and, pitch diameter and the variation tolerance, such that the aerator can be engaged and locked in a metric faucet water outlet and also can be engaged and locked in an imperial faucet water outlet, thereby achieving a universal utilization effect.

3 Claims, 5 Drawing Sheets

| Nominal Size | Pitch | Angles | External(Millimeter) | | | | | | | | |
|---|---|---|---|---|---|---|---|---|---|---|---|
| | | | Class | Major Diameter | | Pitch Diameter | | | UNR Minor Dia | | Effective Length Max |
| | | | | Max | Min | Max | Min | Tol | Max(Ref.) | Min | |
| 55/64"-27UNS(NEU) | 0.941 | 60 | 2A | 21.539 | 21.438 | 21.186 | 20.980 | | | | |
| CW-M22 | 0.960 | 60 | | 21.757 | 21.616 | 21.255 | 21.093 | | | | |
| M22*1.0 | 1.000 | 60 | 6g | 21.974 | 21.794 | 21.324 | 21.206 | 0.118 | 20.891 | 20.590 | |

| Nominal Size | Class | Internal(Millimeter) | | | | | | | |
|---|---|---|---|---|---|---|---|---|---|
| | | Minor Diameter | | Pitch Diameter | | | Major Diameter | | Effective Length Min |
| | | Min | Max | Min | Max | Tol | Min | Max | |
| 55/64"-27UNS(NEO) | 2B | 20.930 | 21.031 | 21.217 | 21.471 | | 21.828 | | |
| CW-M22 | | 20.923 | 21.092 | 21.283 | 21.490 | | | | 4.5 |
| M22*1.0 | 6H | 20.917 | 21.153 | 21.350 | 21.510 | 0.160 | 22.000 | 22.304 | |

| Nominal Size | Pitch | Angles | External(Millimeter) | | | | | | | | | |
|---|---|---|---|---|---|---|---|---|---|---|---|---|
| | | | Class | Major Diameter | | Pitch Diameter | | | UNR Minor Dia | | Effective Length Max |
| | | | | Max | Min | Max | Min | Tol | Max(Ref.) | Min | |
| 55/64"-27UNS(NEO) | 0.941 | 60 | 2A | 21.539 | 21.438 | 21.186 | 20.980 | | | | |
| CW-M22 | 0.960 | 60 | | 21.757 | 21.616 | 21.255 | 21.093 | | | | |
| M22*1.0 | 1.000 | 60 | 6g | 21.974 | 21.794 | 21.324 | 21.206 | 0.118 | 20.891 | 20.590 | |

| Internal(Millimeter) | | | | | | | | | |
|---|---|---|---|---|---|---|---|---|---|
| Nominal Size | Class | Minor Diameter | | Pitch Diameter | | | Major Diameter | | Effective Length Min |
| | | Min | Max | Min | Max | Tol | Min | Max | |
| 55/64"-27UNS(NEO) | 2B | 20.930 | 21.031 | 21.217 | 21.471 | | 21.828 | | |
| CW-M22 | | 20.923 | 21.092 | 21.283 | 21.490 | | | | 4.5 |
| M22*1.0 | 6H | 20.917 | 21.153 | 21.350 | 21.510 | 0.160 | 22.000 | 22.304 | |

FIG. 1

THREAD STRUCTURE OF AERATOR OF FAUCET WATER OUTLET

BACKGROUND OF THE INVENTION (a) Field of the Invention

The present invention relates to a thread structure of an aerator of a water faucet outlet, with the design of the pitch, the major diameter and the pitch diameter of an internal tread of the aerator and the variation tolerance. An effective engagement relation can be established when subject to the different metric and imperial specifications of the external thread of a water faucet outlet. The present invention provides a universal utilization and application.

(b) Description of Related Art

For avoiding an issue of water splashing while controlling the flow amount of discharged water from an faucet, an aerator is often installed on the water faucet outlet to obtain smoother water flow and to prevent water splashing. When water is discharged in a massive amount, the surroundings is prevented from being splashed with water and being wet.

What shall be addressed is that after the mentioned aerator has been used for a period of time, problems such as blocking or permeating may occur. As a result, the aerator is seen as a consuming product which has to be replaced every now and then. For facilitating the detachment and engagement of aerator, the bottom end of the water faucet outlet are often designed with external thread, and the aerator is designed with internal thread. With the matching design of internal and external threads, the aerator and the water faucet outlet can be smoothly and effectively engaged and locked.

However, during the faucet production, the measurement system and custom in different market regions may adopt different specifications. Two commonly used systems are metric and imperial for the matching of the threads of the faucet water outlet and the aerator. Under the two systems, two different specifications of metric and imperial are generated. As a result, a metric aerator cannot be used with an imperial faucet, and an imperial aerator cannot be used with a metric faucet, and a forced engagement of different specifications may cause inadequate engagement and permeation. Thus for the sales of aerator, the aerator is clearly marked with the specification of faucet suitably to be applied, thereby preventing the consumer from buying the unsuitable aerator.

As a matter of fact, most consumers are not aware if the faucets that they have been using are made to metric or imperial specification, or do not have the knowledge to identify the specification of the faucet they are using. Therefore, when buying an aerator, they would not pay the attention to whether the aerator is suitable for their faucet, and often feel frustrated when aerator with wrong specification is purchased. In addition, when the consumer takes the product back to the shop for replacement, the free replacement may not be available because the packaging of the product is damaged or missing, or because the product has some scratches. As a result, extra money has to be paid for getting the right product.

SUMMARY OF THE INVENTION

In view of the problems and disadvantages related to the thread engagement of existing water faucet outlet and aerator, the inventor of the present invention having devoted himself in relative industries for many years and having advanced skills and acknowledge to make an integral design for the metric and imperial thread structures of the faucet and aerator which are commonly seen in the marketplace, invented an improved structure, in which the specification of the external and internal thread of an aerator is designed to be capable of being engaged and locked with both metric and imperial internal thread of faucet water outlets having the same specification, and also capable of being engaged and locked with both metric and imperial external thread of water faucet outlets having the same specification, thereby achieving the practicability and convenience of being universally applicable to both of the metric/imperial internal/external thread of faucet water outlet having the same specification.

Another objective of the present invention is to provide an assembly eliminate the needs of consumers to consider whether the thread of the faucet water outlet is in metric or imperial measurement when buying an aerator for replacement purpose, as long as the aerator matches the specification, so the replacement can be easily done without concerning of buying the wrong product.

Another objective of the present invention is to provide an assembly which allows the inventory to carry product with a single specification, so when orders for aerators with same specification are received, the dispatch can be easily processed, thereby simplifying inventory management and production items.

To achieve the mentioned objectives, the structural design of the present invention, based on the ditch, the major diameter and the ditch diameter of the metric and imperial thread of water faucet outlet and the variation tolerance, calculates the universal measurement of corresponding ditch, major diameter and ditch diameter and the variation tolerance, so that the aerator can be engaged and locked in both metric water faucet outlet and imperial faucet water outlet, thereby achieving a universal utilization effect.

BRIEF DESCRIPTION OF THE DRAWINGS

FIG. 1 is a specification table showing the metric and imperial aerators and the aerator provided by the present invention;

DETAILED DESCRIPTION OF THE PREFERRED EMBODIMENT

Figure 2:
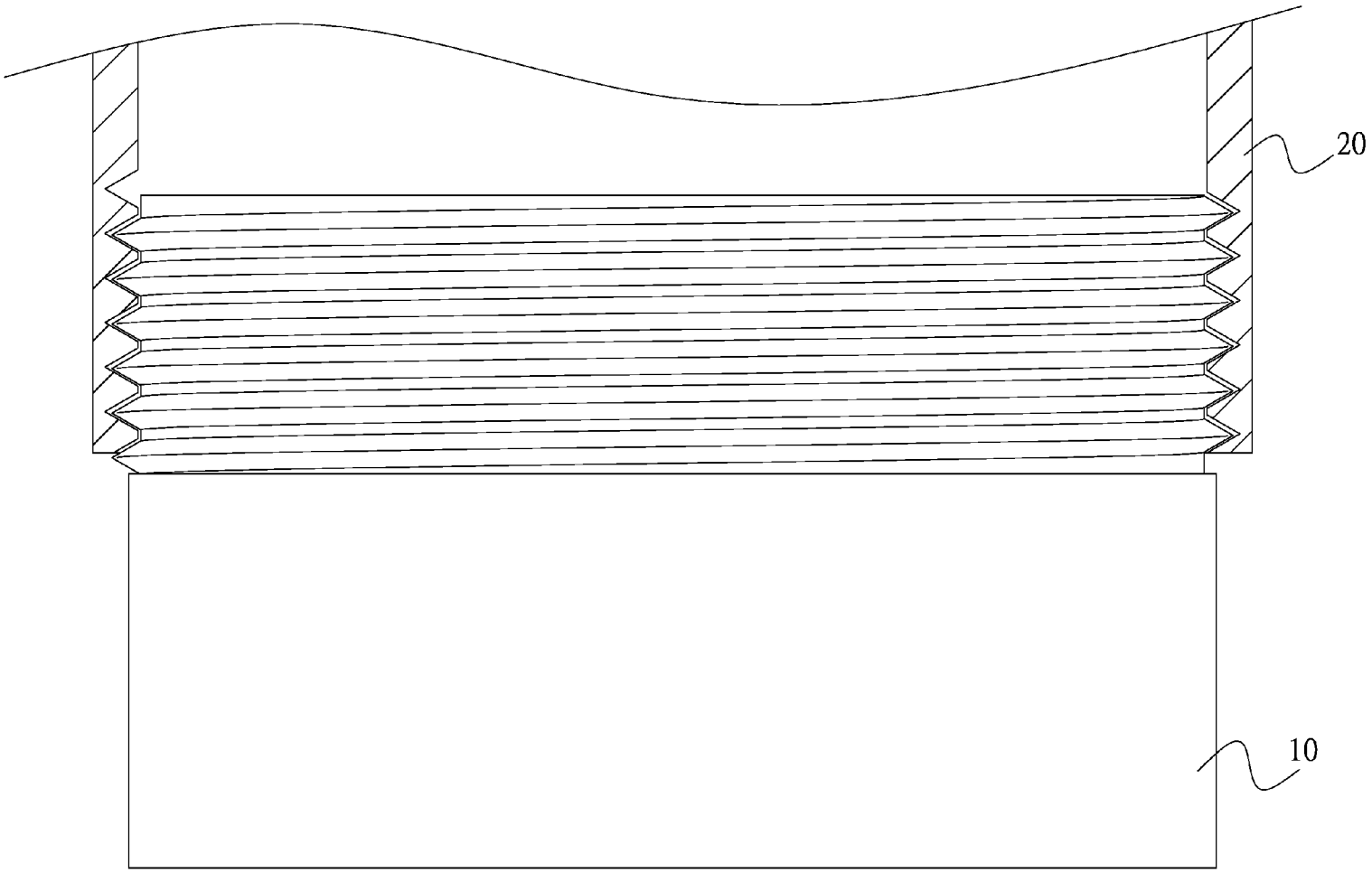
FIG. 2 is a schematic view showing the aerator of the present invention being engaged with the metric internal thread of a water faucet outlet.
Figure 3:
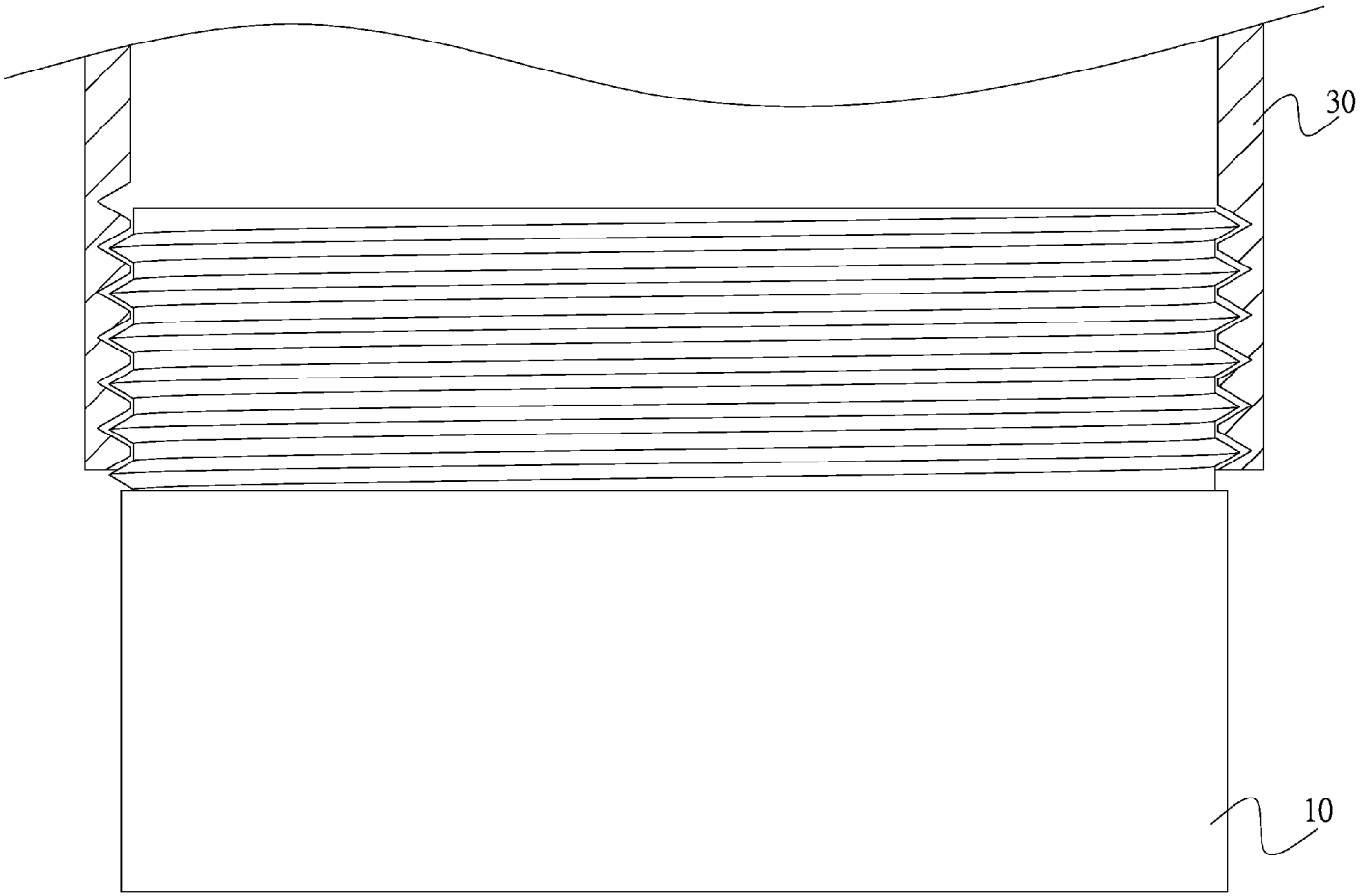
FIG. 3 is a schematic view showing the aerator of the present invention being engaged with the imperial internal thread of a water faucet outlet.
Figure 4:
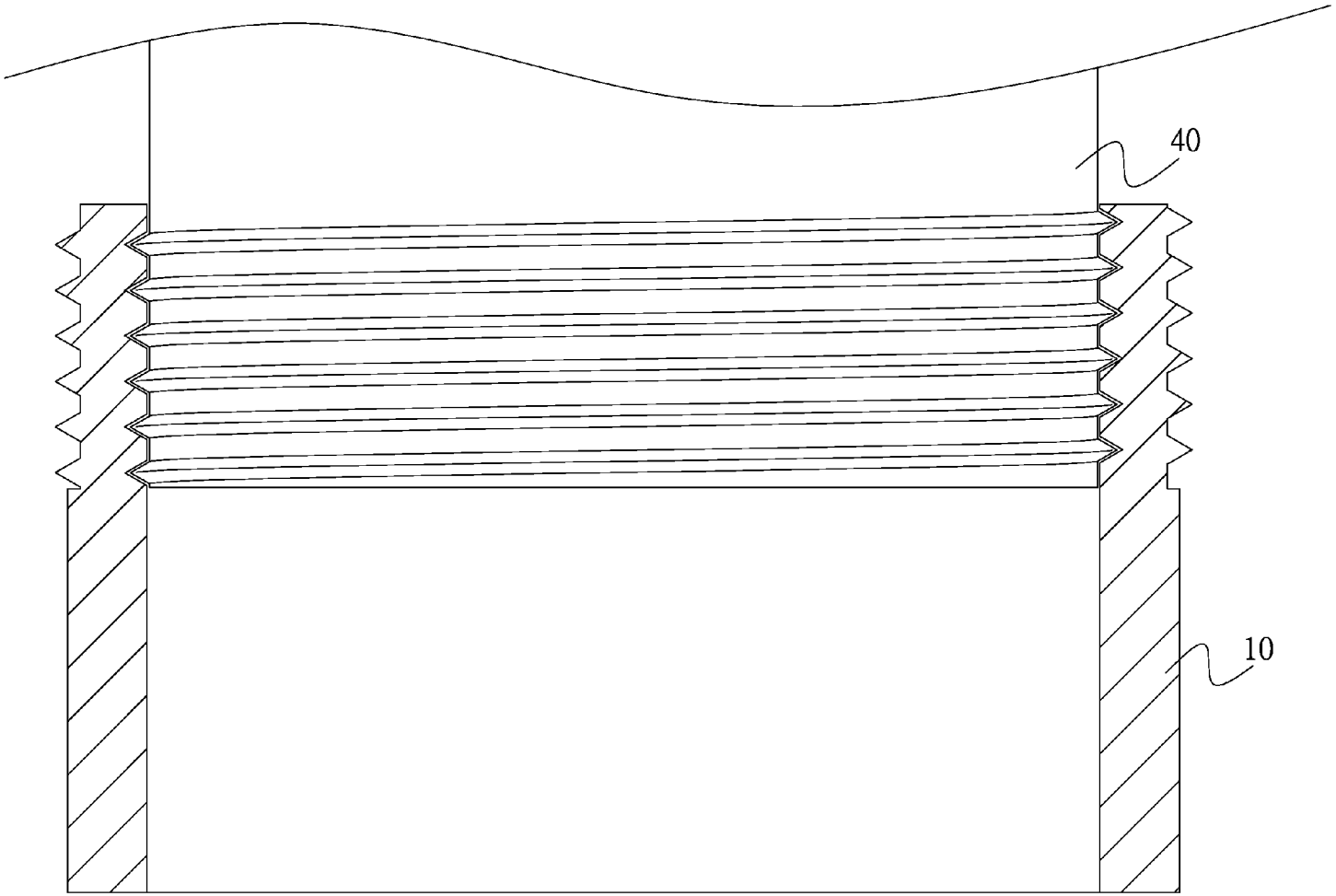
FIG. 4 is a schematic view showing the aerator of the present invention being engaged with the metric external thread of a water faucet outlet.
Figure 5:
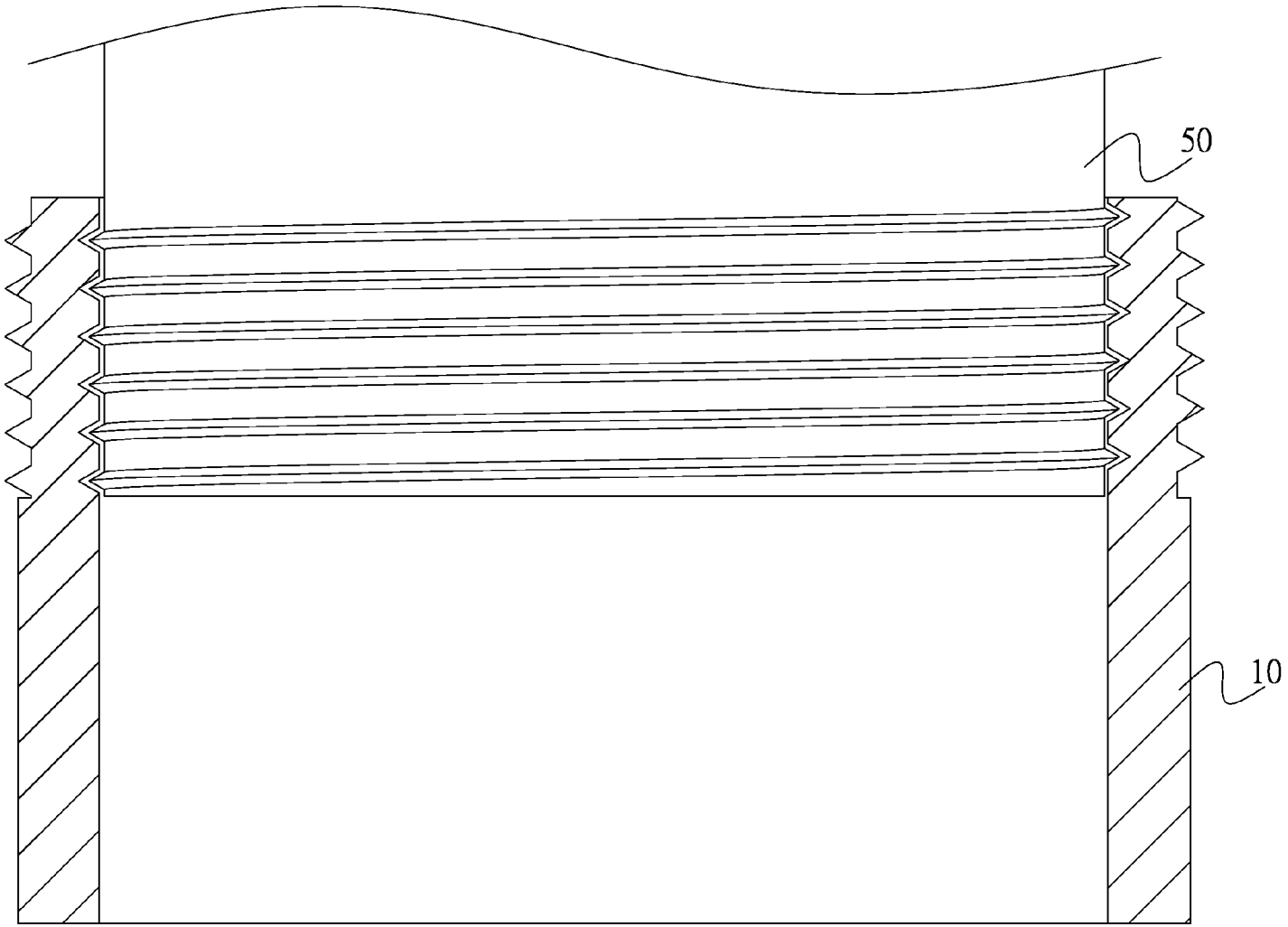
FIG. 5 is a schematic view showing the aerator of the present invention being engaged with the imperial external thread of a water faucet outlet.

The accompanying drawings are included to provide a further understanding of the invention, and are incorporated in and constitute a part of this specification. The drawings illustrate embodiments of the invention and, together with the description, serve to explain the principles of the invention.

According to the present invention, the aerator of the present invention being used in a M22 (55/64") faucet water outlet is adopted as one preferred embodiment for illustration. As shown in figures, for a metric aerator used in a metric (M22) internal thread of a faucet water outlet, the pitch is 1.000 mm, the angle is 60 DEG, the maximum major diameter is 21.974 mm, the minimum major diameter is 21.794 mm, the maximum pitch diameter is 21.324 mm, and the minimum pitch diameter is 21.206 mm; for an imperial aerator used in an imperial (55/64") internal thread of a faucet water outlet, the pitch is 0.941 mm, the angle is 60 DEG, the maximum major diameter is 21.539 mm, the minimum major diameter is 21.438 mm, the maximum pitch diameter is 21.186 mm, and the minimum pitch diameter is 20.980 mm, wherein on the basis of the average values of the mentioned measurements of the pitch, major diameter and pitch diameter, the universal specification (CW-M22) of the aerator provided by the present invention is obtained, in which the pitch is 0.960 mm, the angle is 60 DEG, the maximum major diameter is 21.757 mm, the minimum major diameter is 21.616 mm, the maximum pitch diameter is 21.255 mm, and the minimum pitch diameter is 21.093 mm. With the provided values, it is known that the pitch, major diameter and pitch diameter of the universal aerator 10 of the present invention are all within the specification ranges of the metric and imperial external thread aerators. In addition, since the angle specifications of the conventional metric and imperial aerators and the aerator 10 provided by the present invention are all designed in 60 DEG, no matter the universal aerator 10 of the present invention is engaged with a water faucet outlet having the metric internal thread 20, or a water faucet outlet having the imperial internal thread 30, the engagement and locking can be smoothly done, thereby achieving the practicability of being suitably and universally used in the water faucet outlet having the metric internal thread 20 and the water faucet outlet having the imperial internal thread 30.

In addition, for a metric aerator to be used with a metric (M22) external thread of a faucet water outlet, the pitch is 1.000 mm, the angle is 60 DEG, the maximum minor diameter is 21.153 mm, the minimum minor diameter is 20.917 mm, the maximum pitch diameter is 21.510 mm, and the minimum pitch diameter is 21.350 mm; and for an imperial aerator used in an imperial (55/64") external thread of a faucet water outlet, the pitch is 0.941 mm, the angle is 60 DEG, the maximum minor diameter is 21.031 mm, the minimum minor diameter is 20.930 mm. the maximum pitch diameter is 21.471 mm, and the minimum pitch diameter is 21.217 mm, wherein on the basis of the average values of the mentioned measurements of the pitch, major diameter and pitch diameter, the universal specification (CW-M22) of the aerator provided by the present invention is obtained, in which the pitch is 0.960 mm, the angle is 60 DEG, the maximum minor diameter is 21.092 mm, the minimum minor diameter is 20.930 mm, the maximum pitch diameter is 21.471 mm, and the minimum pitch diameter is 21.217 mm. With the provided values, it is known that the pitch, minor diameter and pitch diameter of the universal aerator 10 of the present invention are all within the specification ranges of the metric and imperial external thread aerators. In addition, since the angle specifications of the conventional metric and imperial aerator and the aerator 10 provided by the present invention are all designed in 60 DEG, no matter if the universal aerator 10 of the present invention is engaged in a water faucet outlet having the metric external thread 40, or the universal aerator 10 of the present invention is engaged in a water faucet outlet having the imperial external thread 50, the engagement and locking can be smoothly done, and an engagement relation having certain thread numbers is formed, thereby achieving the practicability of being suitably and universally used in the water faucet outlet having the metric external thread 40 and the water faucet outlet having the imperial external thread 50.

Based on what is disclosed above, for providing an aerator which can be suitably used in both of the metric and imperial faucet water outlets, the present invention designs the pitch, the angle, the major (minor) diameter and the pitch diameter of an aerator for being applicable to the existed specifications of metric or imperial aerators. As such, when a consumer wants to buy an aerator for the purpose of replacement, he/she only has to consider the specification of the water faucet outlet for choosing a suitable aerator, and does not have to be concerned with the measurement of the faucet water outlet being in metric or imperial. In addition, a manufacturer does not needs to produce both metric and imperial aerators, thereby simplifying its production and inventory management. And further shortening the order delivery date. Therefore, the present invention is valuable in meeting practical needs, and providing better utilization and economic benefit.

According to the aforesaid disclosure, the thread structure of the aerator of water faucet outlet has a designed pitch, major (minor) diameter and pitch diameter, to be engaged with water faucet outlets having the same specification in metric or imperial measurements, thereby providing a function of universal replacement. The present invention overcomes problem and disadvantage that the conventional aerators have to be produced to match both of the metric and imperial measurements for faucet water outlet having the same specification. As a whole, the present invention provides a novel design which has not been seen, used, or launched in any marketplace.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. A thread structure of an aerator for a water faucet outlet, wherein an external thread structure of the aerator enables the aerator to be engaged with both metric and imperial internal threads on the water faucet outlet, wherein the external threat structure comprises:

A pitch of 0.960 mm, an angle of 60 DEG, a maximum major diameter of 21.757 mm, a minimum major diameter of 21.616 mm, a maximum pitch diameter of 21.255 mm, and a minimum pitch diameter of 21.093 mm.

2. A thread structure of an aerator for a water faucet outlet, wherein an internal thread structure of the aerator enables the aerator to be engaged with both metric and imperial internal threads on the water faucet outlet, wherein the internal threat structure comprises:

A pitch of 0.960 mm, an angle of 60 DEG, a maximum minor diameter of 21.092 mm, a minimum minor diameter of 20.930 mm, a maximum pitch diameter of 21.471 mm, and a minimum pitch diameter of 21.217 mm.

3. A thread structure of an aerator for a water faucet outlet, wherein an internal and external thread structure of the aerator enables the aerator to be engaged with both metric and imperial internal threads on the water faucet outlet, wherein the internal threat structure comprises:

a pitch of 0.960 mm, an angle of 60 DEG, a maximum minor diameter of 21.092 mm, a minimum minor diameter of 20.930 mm, a maximum pitch diameter of 21.471 mm, and a minimum pitch diameter of 21.217 mm; and wherein the external thread structure comprises: a pitch of 0.960 mm, an angle of 60 DEG, a maximum major diameter of 21.757 mm, a minimum major diameter of 21.616 mm, a maximum pitch diameter of 21.255 mm, and a minimum pitch diameter is 21.093 mm.

* * * * *